US008348723B2

(12) United States Patent
Woo et al.

(10) Patent No.: US 8,348,723 B2
(45) Date of Patent: Jan. 8, 2013

(54) STRUCTURED ABRASIVE ARTICLE AND METHOD OF USING THE SAME

(75) Inventors: Edward J. Woo, Woodbury, MN (US); Jimmie R. Baran, Jr., Prescott, WI (US); Scott R. Culler, Burnsville, MN (US); Paul D. Graham, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 698 days.

(21) Appl. No.: 12/560,797

(22) Filed: Sep. 16, 2009

(65) Prior Publication Data

US 2011/0065362 A1 Mar. 17, 2011

(51) Int. Cl.
*B24B 1/00* (2006.01)
*B24D 11/00* (2006.01)

(52) U.S. Cl. ..... 451/59; 51/298; 451/527; 451/533; 451/539

(58) Field of Classification Search ..... 51/298, 51/297; 451/36, 41, 59, 63, 527, 533, 539
See application file for complete search history.

(56) References Cited

U.S. PATENT DOCUMENTS

| | | | |
|---|---|---|---|
| 2,871,218 | A | 1/1959 | Schollenberger |
| 3,654,835 | A | 4/1972 | Sievenpiper |
| 4,595,001 | A | 6/1986 | Potter et al. |
| RE33,353 | E | 9/1990 | Heinecke |
| 5,088,483 | A | 2/1992 | Heinecke |
| 5,152,917 | A | 10/1992 | Pieper et al. |
| 5,286,782 | A | 2/1994 | Lamb et al. |
| 5,354,797 | A | 10/1994 | Anderson et al. |
| 5,378,251 | A | 1/1995 | Culler et al. |
| 5,435,816 | A | 7/1995 | Spurgeon et al. |
| 5,453,312 | A | 9/1995 | Haas et al. |
| 5,454,844 | A | 10/1995 | Hibbard et al. |
| 5,489,235 | A | 2/1996 | Gagliardi et al. |
| 5,549,961 | A | 8/1996 | Haas et al. |
| 5,658,184 | A | 8/1997 | Hoopman et al. |
| 5,672,097 | A | 9/1997 | Hoopman |
| 5,681,217 | A | 10/1997 | Hoopman et al. |
| 5,700,302 | A | 12/1997 | Stoetzel et al. |

(Continued)

FOREIGN PATENT DOCUMENTS

WO WO 2006/112909 A1 10/2006

OTHER PUBLICATIONS

"Material Safety Data Sheet, SOLPLUS D520", Jul. 18, 2006, Noveon, United Kingdom.

(Continued)

*Primary Examiner* — Timothy V Eley
(74) *Attorney, Agent, or Firm* — Bradford B. Wright

(57) ABSTRACT

A structured abrasive article includes a backing having a structured abrasive layer disposed on and secured thereto. The structured abrasive layer includes shaped abrasive composites that comprise abrasive particles and nonionic polyether surfactant dispersed in a crosslinked polymeric binder. The abrasive particles have a mean particle size of less than 10 micrometers. The nonionic polyether surfactant is not covalently bound to the crosslinked polymeric binder and is present in an amount of from 2.5 to 3.2 percent by weight based on a total weight of the shaped abrasive composites. The structured abrasive articles are useful for abrading a workpiece.

14 Claims, 1 Drawing Sheet

U.S. PATENT DOCUMENTS

| | | | | |
|---|---|---|---|---|
| 5,733,178 | A | 3/1998 | Ohishi | |
| 5,785,784 | A | 7/1998 | Chesley et al. | |
| 5,833,724 | A | 11/1998 | Wei et al. | |
| 5,851,247 | A | 12/1998 | Stoetzel et al. | |
| 5,855,632 | A | 1/1999 | Stoetzel et al. | |
| 5,863,306 | A | 1/1999 | Wei et al. | |
| 5,908,476 | A | 6/1999 | Nishio et al. | |
| 5,942,015 | A | 8/1999 | Culler et al. | |
| 5,962,120 | A * | 10/1999 | Keipert | 428/317.9 |
| 5,975,987 | A | 11/1999 | Hoopman et al. | |
| 6,048,375 | A | 4/2000 | Yang et al. | |
| 6,076,248 | A | 6/2000 | Hoopman et al. | |
| 6,080,215 | A | 6/2000 | Stubbs et al. | |
| 6,129,540 | A | 10/2000 | Hoopman et al. | |
| 6,139,594 | A | 10/2000 | Kincaid et al. | |
| 6,277,160 | B1 | 8/2001 | Stubbs et al. | |
| 6,293,980 | B2 | 9/2001 | Wei et al. | |
| 6,428,898 | B1 | 8/2002 | Barsotti et al. | |
| 6,544,593 | B1 | 4/2003 | Nagata et al. | |
| 6,838,589 | B2 | 1/2005 | Liedtke et al. | |
| 6,923,840 | B2 | 8/2005 | Schutz et al. | |
| 7,267,700 | B2 | 9/2007 | Collins et al. | |
| 7,278,904 | B2 | 10/2007 | Woo et al. | |
| 2001/0041511 | A1 | 11/2001 | Lack et al. | |
| 2002/0009514 | A1 | 1/2002 | Hoopman et al. | |
| 2002/0026752 | A1 | 3/2002 | Culler et al. | |
| 2002/0028264 | A1 | 3/2002 | Hoopman et al. | |
| 2003/0022604 | A1 | 1/2003 | Annen et al. | |
| 2003/0024169 | A1 | 2/2003 | Kendall et al. | |
| 2003/0032368 | A1 | 2/2003 | Hara | |
| 2003/0143938 | A1 | 7/2003 | Braunschweig et al. | |
| 2005/0060941 | A1 | 3/2005 | Provow et al. | |
| 2005/0060942 | A1 | 3/2005 | Culler et al. | |
| 2005/0060944 | A1 | 3/2005 | Culler et al. | |
| 2005/0060945 | A1 | 3/2005 | Culler et al. | |
| 2005/0064805 | A1 | 3/2005 | Culler et al. | |
| 2011/0065362 | A1 * | 3/2011 | Woo et al. | 451/28 |

OTHER PUBLICATIONS

"Technical Data Sheet Tergitol 15-S-20 Surfactant", DOW, effective date Feb. 5, 2003, 8 pages.

"Technical Data Sheet Tergitol 15-S-5 Surfactant", DOW, date issued Feb. 10, 2003, 8 pages.

"Material Safety Data Sheet Pluronic* L 10", BASF Corporation, May 26, 2009, 6 pages.

PCT International Search Report, PCT/US2010/029553, filed Apr. 1, 2010, Applicant Reference No. 65789WO003, 3 pages.

* cited by examiner

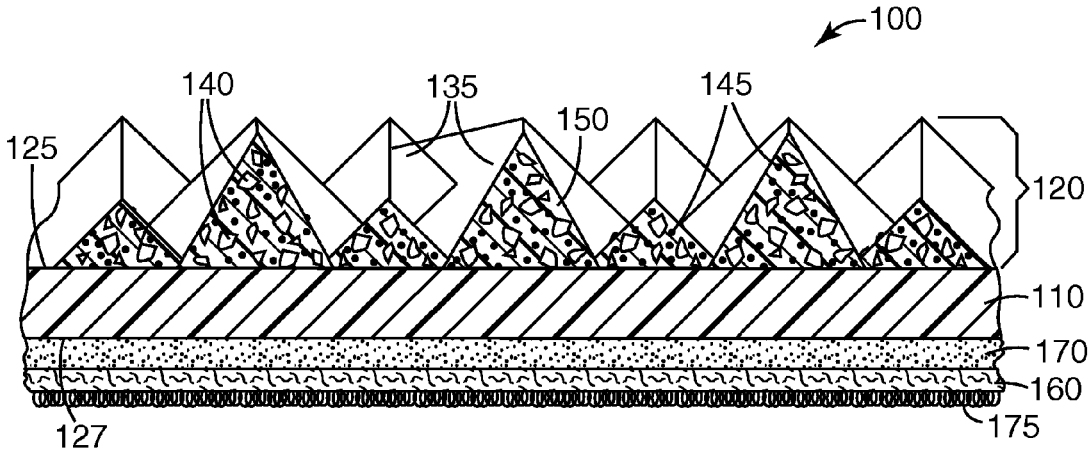
100
140
135
145
150
125
120
110
170
160
127
175

STRUCTURED ABRASIVE ARTICLE AND METHOD OF USING THE SAME

BACKGROUND

Surface finishing and repair of glossy surfaces such as automotive paints and clearcoats, lacquer finishes, glossy plastics, and the like is commonly practiced by a two-step method. First, the surface area to be finished or repaired is abraded with an abrasive article; then in a second step, the abraded surface is polished by buffing it in the presence of a polishing compound.

Structured abrasive articles, that is, those abrasive articles that have a plurality of shaped abrasive composites bonded to a backing, are widely used in the first abrading step. During abrading processes using structured abrasive articles, a liquid such as water or a cutting fluid is often added to the abrading interface to extend the useful life of the structured abrasive article. In the case of water, a surfactant is often used in addition.

SUMMARY

In one aspect, the present disclosure provides a structured abrasive article comprising:

a backing having first and second opposed major surfaces; and a structured abrasive layer disposed on and secured to the first major surface, the structured abrasive layer comprising shaped abrasive composites, wherein the shaped abrasive composites comprise abrasive particles and nonionic polyether surfactant dispersed in a crosslinked polymeric binder, wherein the abrasive particles have a mean particle size of less than 10 micrometers, wherein the nonionic polyether surfactant is not covalently bound to the crosslinked polymeric binder, and wherein the nonionic polyether surfactant is present in an amount of from 2.5 to 3.5 percent by weight based on a total weight of the shaped abrasive composites.

In some embodiments, the nonionic polyether surfactant is present in an amount of from 1.5 to 2.0 percent by weight based on a total weight of the shaped abrasive composites. In some embodiments, the shaped abrasive composites are precisely-shaped. In some embodiments, the crosslinked polymeric binder comprises an acrylic polymer. In some embodiments, the surfactant comprises a polyethylene oxide segment. In some embodiments, the surfactant comprises a polypropylene oxide segment. In some embodiments, the shaped abrasive composites further comprise an anionic phosphate polyether ester, wherein the anionic phosphate polyether ester is present in an amount by weight that is less than that of the nonionic polyether surfactant.

In some embodiments, the backing comprises a polymer film. In some of those embodiments, the polymer film comprises and elastomeric polyurethane.

In some embodiments, the backing comprises a polymer foam. In some embodiments, the structured abrasive article further comprises an attachment interface layer directly bonded to the second major surface. In some embodiments, the structured abrasive article further comprises a layer of pressure-sensitive adhesive disposed on the second major surface.

In another aspect, the present disclosure provides a method of abrading a workpiece, the method comprising:

frictionally contacting at least a portion of the structured abrasive layer of the structured abrasive article according to the present disclosure with a surface of a workpiece while in the presence of an aqueous fluid; and moving at least one of the workpiece or the structured abrasive layer relative to the other to abrade at least a portion of the surface of the workpiece.

Advantageously, structured abrasive articles according to the present disclosure can be used in abrading processes using mere tap water instead of a surfactant solution. Further, at least some of the structured abrasive articles exhibit improved abrading properties (e.g., cut rate and product life) as compared to current industry accepted products.

BRIEF DESCRIPTION OF THE DRAWING

FIG. 1 is a cross-sectional side view of an exemplary structured abrasive article according to the present disclosure.

DETAILED DESCRIPTION

Referring now to FIG. 1, an exemplary structured abrasive article 100, which has abrasive layer 120 disposed on and secured to a first major surface 125 of backing 110. Abrasive layer 120 comprises precisely-shaped abrasive composites 135. Each precisely-shaped abrasive composite 135 comprises abrasive grains 140, optional grinding aid particles 145, and surfactant (not shown) dispersed in a polymeric binder 150. Each precisely-shaped abrasive composite contains from 2.5 to 3.5 percent by weight of a nonionic polyether surfactant based on a total weight of the shaped abrasive composite. As exemplified in FIG. 1, optional attachment layer interface 160 is disposed on second major surface 127 of backing 110, and includes optional pressure-sensitive adhesive layer 170 and optional looped fabric 175. Optional looped fabric 175 may be bonded to second major surface 127 by optional pressure-sensitive adhesive layer, if present, or through other direct contact bonding methods (e.g., heat lamination, stitchbonding, ultrasonic welding).

As used herein, the term "shaped abrasive composite" refers to a body that comprises abrasive particles and a binder, and is intentionally formed in a non-random shape (e.g., a pyramid, ridge, etc.), and typically characterized by regular boundaries. Exemplary forming methods include cast and cure methods, embossing, and molding. The shaped abrasive composites may be disposed on the backing according to a predetermined pattern (e.g., as an array). In some embodiments, shaped abrasive composites are "precisely-shaped". This means that the shape of the abrasive composites is defined by relatively smooth surfaced sides that are bounded and joined by well-defined edges having distinct edge lengths with distinct endpoints defined by the intersections of the various sides. The terms "bounded" and "boundary" refer to the exposed surfaces and edges of each composite that delimit and define the actual three-dimensional shape of each abrasive composite. These boundaries are readily visible and discernible when a cross-section of an abrasive article is viewed under a scanning electron microscope. These boundaries separate and distinguish one precisely-shaped abrasive composite from another even if the composites abut each other along a common border at their bases. By comparison, in an abrasive composite that does not have a precise shape, the boundaries and edges are not well defined (e.g., where the abrasive composite sags before completion of its curing).

Precisely-shaped abrasive composites may be of any three-dimensional shape that results in at least one of a raised feature or recess on the exposed surface of the abrasive layer. Useful shapes include, for example, cubic, prismatic, pyramidal (e.g., square pyramidal or hexagonal pyramidal), truncated pyramidal, conical, frustoconical. Combinations of differently shaped and/or sized abrasive composites may also be used. The abrasive layer of the structured abrasive may be continuous or discontinuous.

Further details concerning structured abrasive articles having precisely-shaped abrasive composites, and methods for their manufacture may be found, for example, in U.S. Pat. Nos. 5,152,917 (Pieper et al.); 5,435,816 (Spurgeon et al.); 5,672,097 (Hoopman); 5,681,217 (Hoopman et al.); 5,454,844 (Hibbard et al.); 5,851,247 (Stoetzel et al.); and 6,139,594 (Kincaid et al.).

Typically, the shaped abrasive composites are arranged on the backing according to a predetermined pattern or array, although this is not a requirement. The shaped abrasive composites may be arranged such that some of their work surfaces are recessed from the polishing surface of the abrasive layer.

For fine finishing applications, the density of shaped abrasive composites in the abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

In yet another embodiment, the structured abrasive article may be prepared by coating a slurry comprising a polymerizable binder precursor, surfactant, and abrasive grains through a screen that is in contact with a backing. In this embodiment, the slurry is typically then further polymerized (e.g., by exposure to an energy source) while it is present in the openings of the screen thereby forming a plurality of shaped abrasive composites generally corresponding in shape to the screen openings. Further details concerning this type of screen coated structured abrasive may be found, for example, in U.S. Publ. Pat. Appl. No. 2001/0041511 (Lack et al.).

In another embodiment, a slurry comprising a polymerizable binder precursor, surfactant, abrasive grains, and a silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. General processes for preparing such embossed structured abrasive articles are described in, for example, U.S. Pat. Nos. 5,833,724 (Wei et al.); 5,863,306 (Wei et al.); 5,908,476 (Nishio et al.); 6,048,375 (Yang et al.); 6,293,980 (Wei et al.); and U.S. Pat. Appl. Pub. No. 2001/0041511 (Lack et al.).

The structured abrasive article can be any shape, for example, round (e.g., a disc), oval, or rectangular (e.g., a sheet) depending on the particular shape of any support pad that may be used in conjunction with it, or it may form an endless belt. The structured abrasive article may have slots or slits therein and may be provided with perforations (e.g., a perforated disc), and/or may have scalloped edges.

The individual shaped abrasive composites comprise abrasive grains and surfactant dispersed in a polymeric binder.

Any abrasive grain known in the abrasive art may be included in the abrasive composites. Examples of useful abrasive grains include aluminum oxide, fused aluminum oxide, heat-treated aluminum oxide, ceramic aluminum oxide, silicon carbide, green silicon carbide, alumina-zirconia, ceria, iron oxide, garnet, diamond, cubic boron nitride, and combinations thereof. For repair and finishing applications, useful abrasive grain sizes typically range from an average particle size of from at least 0.01, 1, 3 or even 5 micrometers up to and including 35, 100, 250, 500, or even as much as 1,500 micrometers, although particle sizes outside of this range may also be used. Silicon carbide abrasive particles having an abrasives industry specified nominal grade corresponding to sizes in a range of from 3 and 7 micrometers are typically preferred. Typically, the abrasive particles are included in the abrasive composites in an amount of from 50 to 70 percent by weight, based on a total weight of the shaped abrasive composites, although other amounts may also be used.

Examples of polymeric binders that are useful in abrasive composites include thermoplastic resins such as for example, polyesters, polyamides, and combinations thereof; thermosetting resins such as, for example, phenolic resins, aminoplast resins, urethane resins, epoxy resins, acrylic resins, acrylated isocyanurate resins, cyanate resins, urea-formaldehyde resins, isocyanurate resins, acrylated urethane resins, acrylated epoxy resins, glue, and combinations thereof; and combinations thereof.

In the case of thermosetting resins, the binder is typically prepared by polymerizing and/or curing a binder precursor. One preferred binder precursor is a resin or resin mixture that polymerizes via a free-radical mechanism. The polymerization process is initiated by exposing the binder precursor, along with an appropriate catalyst, to an energy source such as thermal energy or radiation energy. Examples of radiation energy include electron beam, ultraviolet light or visible light.

Examples of free-radically curable resins include acrylated urethanes, acrylated epoxies, acrylated polyesters, ethylenically-unsaturated monomers, aminoplast monomers having pendant unsaturated carbonyl groups, isocyanurate monomers having at least one pendant acrylate group, isocyanate monomers having at least one pendant acrylate group and mixtures and combinations thereof. As used herein, the term "(meth)acrylate" encompasses acrylates and methacrylates, individually or in combination.

One exemplary binder precursor comprises a urethane acrylate oligomer, or a blend of a urethane acrylate oligomer and an ethylenically-unsaturated monomer. The preferred ethylenically-unsaturated monomers are monofunctional (meth)acrylate monomers, difunctional (meth)acrylate monomers, trifunctional (meth)acrylate monomers or combinations thereof.

Representative examples of ethylenically-unsaturated monomers include methyl (meth)acrylate, ethyl(meth)acrylate, styrene, divinylbenzene, hydroxyethyl (meth)acrylate, hydroxypropyl(meth)acrylate, hydroxybutyl(meth)acrylate, vinyl toluene, ethylene glycol di(meth)acrylate, polyethylene glycol di(meth)acrylate, hexanediol di(meth)acrylate, triethylene glycol di(meth)acrylate, trimethylolpropane tri(meth) acrylate, glycerol tri(meth)acrylate, pentaerthyitol tri(meth) acrylate, and pentaerythritol tetra(meth)acrylate. Other ethylenically-unsaturated monomers or oligomers include monoallyl, polyallyl, and polymethallyl esters and amides of carboxylic acids, such as diallyl phthalate, diallyl adipate, and N,N-diallyladipamide. Still other nitrogen containing compounds include tris(2-acryloxyethyl)isocyanurate, 1,3,5-tri (2-methacryloxyethyl)-s-triazine, acrylamide, methylacrylamide, N-methylacrylamide, N,N-dimethylacrylamide, N-vinylpyrrolidone, and N-vinylpiperidone.

Examples of commercially available acrylated urethanes include those known by the trade designations: PHOTOMER (for example, PHOTOMER 6010 from Henkel Corp. of Hoboken, N.J.; EBECRYL (for example, EBECRYL 220 (a hexafunctional aromatic urethane acrylate of molecular weight 1000), EBECRYL 284 (aliphatic urethane diacrylate of 1200 grams/mole molecular weight diluted with 1,6-hexanediol diacrylate), EBECRYL 4827 (aromatic urethane diacrylate of 1600 grams/mole molecular weight), EBECRYL 4830 (aliphatic urethane diacrylate of 1200 grams/mole molecular weight diluted with tetraethylene glycol diacrylate), EBECRYL 6602 (trifunctional aromatic urethane acrylate of 1300 grams/mole molecular weight diluted with trimethylolpropane ethoxy triacrylate), and EBECRYL 840 (aliphatic urethane diacrylate of 1000 grams/mole molecular weight)) from UCB Radcure of Smyrna, Ga.; SARTOMER (for example, SARTOMER 9635, 9645, 9655, 963-B80, and 966-A80) from Sartomer Co., West Chester, Pa.; and UVITHANE (for example, UVITHANE 782) from Morton International, Chicago, Ill.

Acrylated epoxies are acrylate esters of epoxy resins such as, for example, diacrylate esters of bisphenol A epoxy resin. Examples of commercially available acrylated epoxies include those available as CMD 3500, CMD 3600, and CMD 3700 from UCB Radcure, and as CN103, CN104, CN111, CN112, and CN114 from Sartomer Co.

Examples of polyester acrylates include those available as PHOTOMER 5007 and PHOTOMER 5018 from Henkel Corp.

Aminoplast monomers have at least one pendant alpha, beta-unsaturated carbonyl group. These unsaturated carbonyl groups may be acrylate, methacrylate or acrylamide type groups. Examples of such materials include N-(hydroxymethyl)-acrylamide, N,N'-oxydimethylenebisacrylamide, ortho- and para-acrylamidomethylated phenol, acrylamidomethylated phenolic novolac and combinations thereof.

Depending upon how the binder precursor is cured or polymerized, the binder precursor may further comprise an effective amount of one or more curing agents (e.g., catalyst(s), hardener(s), thermal initiator(s), and/or photoinitiator(s)) to cure the binder precursor, typically in amounts up to about 10 weight percent of the binder precursor).

In the case of free-radical curing agents, when exposed to an appropriate energy source, they generate a free-radicals that initiate polymerization. Free-radical photoinitiators are typically preferred, and are widely known and available from suppliers such as, for example, Sartomer Corp. and Ciba Specialty Chemicals of Tarrytown, N.Y. Exemplary photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (e.g., as available as IRGACURE 651 from Ciba Specialty Chemicals), benzoin methyl ether, benzoin ethyl ether, benzoin n-butyl ether; acetophenone and its derivatives such as 2-hydroxy-2-methyl-1-phenyl-1-propanone (e.g., as available as DAROCUR 1173 from Ciba Specialty Chemicals), 1-hydroxycyclohexyl phenyl ketone (e.g., as available as IRGACURE 184 from Ciba Specialty Chemicals), 2-methyl-1-[4-(methylthio)phenyl]-2-(4-morpholinyl)-1-propanone (e.g., as available as IRGACURE 907 from Ciba Specialty Chemicals), and 2-benzyl-2-(dimethylamino)-1-[4-(4-morpholinyl)phenyl]-1-butanone (e.g., as available as IRGACURE 369 from Ciba Specialty Chemicals).

Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis(eta.sub.5-2,4-cyclopentadien-1-yl)-bis[2,6-difluoro-3-(1H-pyrrol-1-yl-)phenyl]titanium (e.g., as available as CGI 784DC from Ciba Specialty Chemicals); halomethylnitrobenzenes (e.g., 4-bromomethylnitrobenzene), mono- and bis-acylphosphines (e.g., as available from Ciba Specialty Chemicals under the trade designations IRGACURE 1700, IRGACURE 1800, IRGACURE 1850, and DAROCUR 4265).

One or more sensitizers (e.g., dyes) may be added in combination with the photoinitiator, for example, in order to increase sensitivity of a photoinitiator to a specific source of actinic radiation.

Another binder precursor comprises an epoxy resin. Epoxy resins have oxirane rings that are polymerized by a ring opening reaction. Such epoxy resins include monomeric epoxy resins and polymeric epoxy reins. Examples of some preferred epoxy resins include 2,2-bis-4-(2,3-epoxypropoxy)-phenyl)propane, a diglycidyl ether of bisphenol, as EPON 828, EPON 1004, and EPON 1001F from Resolution Performance Products of Houston, Tex., and as DER-331, DER-332, and DER-334 from Dow Chemical Co. of Midland, Mich. Other suitable epoxy resins include cycloaliphatic epoxies, glycidyl ethers of phenol formaldehyde novolac (for example, DEN-431 and DEN-428), commercially available from Dow Chemical Co.

Useful curatives for epoxy resins include, for example, dicyandiamide and/or bisimidazoles.

To promote an association bridge between the abovementioned binder resin and the abrasive particles, a silane coupling agent is included in the slurry of abrasive grains and solidifiable or polymerizable precursor, typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive grains.

Suitable silane coupling agents include, for example, gamma-methacryloxy-propyltrimethoxysilane, vinyltriethoxysilane, tris(2-methoxyethoxy)vinylsilane, 3,4-epoxycyclohexylmethyltrimethoxysilane, gamma-glycidoxypropyltrimethoxysilane, and gamma-mercaptopropyltrimethoxysilane (e.g., as respectively available as A-174, A-151, A-172, A-186, A-187, and A-189 from Dow Chemical Co.); allyltriethoxysilane, diallyldichlorosilane, divinyldiethoxysilane, and m,p-styrylethyltrimethoxysilane (e.g., as commercially available respectively as A0564, D4050, D6205, and S1588 from United Chemical Industries, Bristol, Pa.); dimethyldiethoxysilane, dihydroxydiphenylsilane; triethoxysilane; trimethoxysilane; triethoxysilanol; 3-(2-aminoethylamino)-propyltrimethoxysilane; methyltrimethoxysilane; vinyltriacetoxysilane; methyltriethoxysilane; tetraethyl orthosilicate; tetramethyl orthosilicate; ethyltriethoxysilane; amyltriethoxysilane; ethyltrichlorosilane; amyltrichlorosilane; phenyltrichlorosilane; phenyltriethoxysilane; methyltrichlorosilane; methyldichlorosilane; dimethyldichlorosilane; and similar compounds; and mixtures thereof.

The shaped abrasive composites may optionally contain additional ingredients such as, for example, dispersants, fillers, pigments, grinding aids, photoinitiators, hardeners, curatives, stabilizers, antioxidants, and light stabilizers.

Suitable optional grinding aids include particulate material, the addition of which has a significant effect on the chemical and physical processes of abrading which results in improved performance. In particular, a grinding aid may 1) decrease the friction between the abrasive grains and the workpiece being abraded, 2) prevent the abrasive grain from "capping" (that is, prevent metal particles from becoming welded to the tops of the abrasive grains), 3) decrease the interface temperature between the abrasive grains the workpiece, and/or 4) decrease the grinding forces. In general, the addition of a grinding aid increases the useful life of the coated abrasive. Grinding aids encompass a wide variety of different materials and can be inorganic- or organic-based.

Examples of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include tin, lead, bismuth, cobalt, antimony, cadmium, iron, and titanium. Examples of other grinding aids include sulfur, organic sulfur compounds, graphite, and metallic sulfides. A combination of different grinding aids can also be used. The above mentioned examples of grinding aids are meant to be a representative showing of grinding aids and are not meant to encompass all grinding aids.

The amount of polyether nonionic surfactant present in the shaped abrasive composites is in a range of from 2.5 to 3.5 percent by weight, based on a total weight of the shaped abrasive composites. For example, in some embodiments, the amount of polyether nonionic surfactant present in the shaped abrasive composites is in a range of from 2.5 to 3.0 percent by weight, based on a total weight of the shaped abrasive composites, In some embodiments, the amount of polyether nonionic surfactant present in the shaped abrasive composites is in a range of from 2.8 to 3.2 percent by weight, based on a total weight of the shaped abrasive composites As used herein, the term polyether nonionic surfactant refers to one or more nonionic (i.e., not having a permanent charge) surfactant(s) that has/have a polyether segment, typically forming at least a portion of the backbone of the surfactant, although this is not a requirement. As is generally the case for surfactants, the polyether nonionic surfactant should not be covalently bound to the crosslinked polymeric binder. To facilitate dissolution into the aqueous fluid, the polyether nonionic surfactant typically has a molecular weight in a range of from 300-1200 grams per mole, although higher and lower molecular weights may be used.

Examples of polyether nonionic surfactants include polyoxyethylene alkyl ethers, polyoxyethylene alkyl-phenyl ethers, polyoxyethylene acyl esters, polyoxyethylene alkylamines, polyoxyethylene alkylamides, polyoxyethylene lauryl ether, polyoxyethylene cetyl ether, polyoxyethylene stearyl ether, polyoxyethylene oleyl ether, polyoxyethylene octylphenyl ether, polyoxyethylene nonylphenyl ether, polyethylene glycol laurate, polyethylene glycol stearate, polyethylene glycol distearate, polyethylene glycol oleate, oxyethylene-oxypropylene block copolymer, polyoxyethylene sorbitan laurate, polyoxyethylene sorbitan stearate, polyoxyethylene sorbitan oleate, and polyoxyethylene laurylamide.

Useful polyether nonionic surfactants also include, for example, condensation products of a higher aliphatic alcohol with about 3 equivalents to about 100 equivalents of ethylene oxide (e.g., those marketed by Dow Chemical Co. under the trade designation TERGITOL 15-S such as, for example, TERGITOL 15-S-20; and those marketed by ICI Americas of Bridgewater, N.J. under the trade designation BRIJ such as, for example, BRIJ 58, BRIJ 76, and BRIJ 97). BRIJ 97 surfactant is polyoxyethylene (10) oleyl ether; BRIJ 58 surfactant is polyoxyethylene (20) cetyl ether; and BRIJ 76 surfactant is polyoxyethylene (10) stearyl ether.

Useful polyether nonionic surfactants also include, for example, polyethylene oxide condensates of an alkyl phenol with about 3 equivalents to about 100 equivalents of ethylene oxide (e.g., those marketed by Rhodia of Cranbury, N.J. under the trade designations IGEPAL CO and IGEPAL CA). IGEPAL CO surfactants include nonylphenoxy poly(ethyleneoxy)ethanols. IGEPAL CA surfactants include octylphenoxy poly(ethyleneoxy)ethanols.

Useful polyether nonionic surfactants also include, for example, block copolymers of ethylene oxide and propylene oxide or butylene oxide (e.g., those marketed by BASF Corp. of Mount Olive, N.J. under the trade designations PLURONIC (e.g., PLURONIC L10) and TETRONIC). PLURONIC surfactants may include propylene oxide polymers, ethylene oxide polymers, and ethylene oxide-propylene oxide block copolymers. TETRONIC surfactants include ethylene oxide-propylene oxide block copolymers.

Useful polyether nonionic surfactants also include, for example, polyoxyethylene sorbitan fatty acid esters (e.g., polyoxyethylene sorbitan monooleates, which may have differing degrees of ethoxylation such as, for example, 20 ethylene oxide units per molecule (e.g., marketed as TWEEN 60) or 20 ethylene oxide units per molecule (e.g., marketed as TWEEN 80)) and polyoxyethylene stearates (e.g., those marketed under the trade designations TWEEN and MYRJ by Uniqema of New Castle, Del.). TWEEN surfactants include poly(ethylene oxide) $C_{12}$-$C_{18}$ sorbitan monoesters. MYRJ surfactants include poly(ethylene oxide) stearates.

In some embodiments, polyether nonionic surfactant is the only surfactant present in the shaped abrasive composites or in the aqueous fluid during abrading. In some cases, it may be desirable to add lesser quantities of anionic surfactants such as an anionic phosphate polyether ester available as TRITON H55 from Dow Chemical Co.

Useful backings include, for example, film backings and foam backings.

Suitable film backings include polymeric films and primed polymeric films, especially those used in the abrasive arts. Useful polymeric films include, for example, polyester films (e.g., an ethylene-acrylic acid copolymer primed polyethylene terephthalate), polyolefin films (e.g., polyethylene or polypropylene films), and elastic polyurethane films. The film backing may be a laminate of two polymeric films. Examples of elastomeric polyurethanes that may be used to form films include those available under the trade designation ESTANE from B.F. Goodrich and Co. of Cleveland, Ohio and those described in U.S. Pat. Nos. 2,871,218 (Schollenberger); 3,645,835 (Hodgson); 4,595,001 (Potter et al.); 5,088,483 (Heinecke); 6,838,589 (Liedtke et al.); and RE 33,353 (Heinecke). Pressure-sensitive adhesive-coated polyurethane elastomer films are commercially available from 3M Company under the trade designation TEGADERM. Useful polymeric films are generally from about 0.02 to about 0.5 millimeters in thickness, for example, from 0.02 millimeter to 0.1 millimeter in thickness; however, this is not a requirement.

Useful polymeric foams include open cell and closed cell polymeric foams, typically compressible and resilient. Useful polymeric foams include elastic foams such as, for example, chloroprene rubber foams, ethylene/propylene rubber foams, butyl rubber foams, polybutadiene foams, polyisoprene foams, EPDM polymer foams, polyurethane foams, ethylene-vinyl acetate foams, neoprene foams, and styrene/butadiene copolymer foams. Useful foams also include thermoplastic foams such as, for example, polyethylene foams, polypropylene foams, polybutylene foams, polystyrene foams, polyamide foams, polyester foams, plasticized polyvinyl chloride (i.e., pvc) foams. Examples of useful open cell foams include polyester polyurethane foams available from Illbruck, Inc. of Minneapolis, Minn. under the trade designations R 200U, R 400U, R 600U and EF3-700C.

Useful foam backings are generally from about 1 to about 15 millimeters in thickness; however this is not a requirement.

The backing can have an attachment interface layer on its back surface to secure the abrasive article to a support pad or back-up pad. This attachment system half can be, for example, a pressure-sensitive adhesive or tape, a loop fabric for a hook and loop attachment, a hook structure for a hook and loop attachment, or an intermeshing attachment system. Further details concerning such attachment systems may be found, for example, in U.S. Pat. Nos. 5,152,917 (Pieper et al.); 5,454,844 (Hibbard et al.); 5,672,097 (Hoopman); 5,681,217 (Hoopman et al.); and U.S. Pat. Appl. Pub. Nos. 2003/0143938 A1 (Braunschweig et al.) and 2003/0022604 A1 (Annen et al.).

Structured abrasive articles (especially those having precisely-shaped abrasive composites) may be prepared by forming a slurry of abrasive grains and a solidifiable or polymerizable precursor of the abovementioned binder resin (i.e., a binder precursor), contacting the slurry with a backing and solidifying and/or polymerizing the binder precursor (e.g., by exposure to an energy source) in a manner such that the resulting structured abrasive article has a plurality of shaped abrasive composites affixed to the backing. Examples of energy sources include thermal energy and radiant energy (e.g., including electron beam, ultraviolet light, and visible light).

For example, in some embodiments, the slurry may be coated directly onto a production tool having precisely-shaped cavities therein and brought into contact with the backing, or coated on the backing and brought to contact with the production tool. In this embodiment, the slurry is typically then solidified or cured while it is present in the cavities of the production tool.

The choice of curing conditions typically depends on the particular binder precursor used, and is within the capability of one of ordinary skill in the art. In general, it is important that a substantially complete cure is obtained to fully realize the benefits of the present disclosure. That is, additional curing at the same temperature and/or wavelengths does not substantially change the abrasive properties. At lesser degrees of curing, the abrasive composites tend to break down more rapidly and less surfactant is generally needed; however, the overall abrasive properties are generally degraded at such lesser degrees of cure.

Typically, a period of time (e.g., at least about 24 hours) is allowed to elapse before the structured abrasive article is used in abrading processes, although this is not a requirement. In some cases, abrading performance may be reduced if the structured abrasive article is used in abrading processes prior to such aging.

The workpiece may comprise any material and may have any form. Examples of suitable materials include ceramic, paint, thermoplastic or thermoset polymers, polymeric coatings, polycrystalline silicon, wood, marble, and combinations thereof. Examples of substrate forms include molded and/or shaped articles (e.g., optical lenses, automotive body panels, boat hulls, counters, and sinks), wafers, sheets, and blocks. Methods according to the present disclosure are particularly useful for repair and/or polishing of polymeric materials such as motor vehicle paints and clearcoats (e.g., automotive clearcoats), examples of which include: polyacrylic-polyol-polyisocyanate compositions (e.g., as described in U.S. Pat. No. 5,286,782 (Lamb, et al.); hydroxyl functional acrylic-polyol-polyisocyanate compositions (e.g., as described in U.S. Pat. No. 5,354,797 (Anderson, et al.); polyisocyanate-carbonate-melamine compositions (e.g., as described in U.S. Pat. No. 6,544,593 (Nagata et al.); high solids polysiloxane compositions (e.g., as described in U.S. Pat. No. 6,428,898 (Barsotti et al.)). One suitable clearcoat comprises nanosized silica particles dispersed in a crosslinked polymer. An example of this clearcoat is available as CERAMICLEAR from PPG Industries of Pittsburgh, Pa. Other suitable materials that may be repaired and/or polished according to the present disclosure include marine gel coats, polycarbonate lenses, countertops and sinks made from synthetic materials, for example, such as those marketed as DUPONT CORIAN by E.I. du Pont de Nemours and Company of Wilmington, Del.

In typical usage of structured abrasive articles according to the present disclosure, the abrasive layer is brought into frictional contact with a surface of a workpiece and then at least one of the structured abrasive article or the workpiece is moved relative to the other to abrade at least a portion of the workpiece. In order to facilitate swarf (i.e., loose dust and debris generated during abrasion of the workpiece) removal surface the process is carried out in the presence of an aqueous fluid. As used herein, the term "aqueous" means containing at least 30 percent water by weight). Typically, the liquid comprises at least 90 or even at least 95 percent by weight of water. For example, the liquid may comprise (or consist of) municipal tap water or well water. During abrading, the aqueous liquid will contain nonionic polyether surfactant that dissolves out of the structured abrasive article. Without wishing to be bound by theory, it is believed that this decreases adverse swarf loading (e.g., accumulation of swarf between adjacent shaped abrasive composites) of the structured abrasive article and facilitates erosion of the shaped abrasive composites which increases cut life.

If desired the aqueous fluid may contain additional components besides water such as, for example, water miscible organic solvents (e.g., alcohols such as ethanol, 2-ethoxy ethanol and including polyols such as propylene glycol and/or polyethers such as diglyme), surfactants, and grinding aids. Advantageously, the aqueous fluid may be free of additional surfactant other than nonionic polyether surfactant, although this is not a requirement. In practice, the aqueous fluid may be applied to the surface of the workpiece, the abrasive layer, or both.

The structured abrasive article may be moved relative to the workpiece by hand or by mechanical means such as, for example, an electric or air-driven motor using any method known in the abrasive art. The structured abrasive article may be removably fastened to a back up pad (e.g., as is common practice with discs) or may be used without a back up pad (e.g., in the case of abrasive belts).

Once abrading using the structured abrasive article is complete, the workpiece is typically rinsed (e.g., with water) to remove residue generated during the abrading process. After rinsing, the workpiece may be further polished using a polishing compound, for example, in conjunction with a buffing pad. Such optional polishing compound typically contains fine abrasive particles (e.g., having an average particle size of less than 100 micrometers, less than 50 micrometers, or even less than 25 micrometers) in a liquid vehicle. Further details concerning polishing compounds and processes are described in, for example, U.S. Pat. Appl. Pub. No. 2003/0032368 (Hara).

Objects and advantages of this disclosure are further illustrated by the following non-limiting examples, but the particular materials and amounts thereof recited in these examples, as well as other conditions and, details, should not be construed to unduly limit this disclosure.

EXAMPLES

Unless otherwise noted, all parts, percentages, ratios, etc. in the examples and the rest of the specification are by weight.

The following abbreviations are used in the Examples below:

"ABR1" refers to a structured abrasive disc having an abrasive layer composed of a close packed off-set array of tetrahedral abrasive composites each having a base width of 92 micrometers, a height of 63 micrometers, and composed of green silicon carbide abrasive grains (4.0 micrometers mean particle size) dispersed in a polymeric binder, obtained as 3M TRIZACT FILM 466LA, A5 DISC from 3M Company of Saint Paul, Minn.;

"ABR2" refers to structured abrasive disc having an abrasive layer of close packed, alternating 34 degree helical cut, pyramidal arrays having 11 by 11 rows of base width 3.3 mils by 3.3 mils (83.8 by 83.8 micrometers) by 2.5 mils (63.5 micrometers) depth, separated by 3 by 3 rows of the same pyramidal array truncated to a depth of 0.83 mil (21 micrometers), and composed of green silicon carbide abrasive grains (4.0 micrometers mean particle size) dispersed in a polymeric binder, article obtained under the trade designation 3M TRIZACT FILM 460LA, A5 DISC from 3M Company;

"ABR3" through "ABR7" refer to structured abrasive discs made generally according to the procedure described in Examples 1-5 and amounts of surfactant as indicated in Table 1;

"ACR1" refers to 2-phenoxy acrylate, commercially available as SR339 from Sartomer Co. of Exton, Pa.;

"ACR2" refers to trimethylolpropane triacrylate, commercially available as SR351 from Sartomer Company;

"AD1" refers to a secondary alcohol ethoxylate (5 moles ethylene oxide) (polyether nonionic surfactant) available as TERGITOL 15-S-5 from Dow Chemical Corp. of Midland, Mich.;

"CPA1" refers to gamma-methacryloxypropyltrimethoxysilane, available as A-174 from Crompton Corp. of Middlebury, Conn.;

"MIN1" refers to green silicon carbide mineral, D50=4.0 micrometers, available as GC 3000 GREEN SILICON CARBIDE from Fujimi Corp. of Tualitin, Oreg.;

"MIN2" refers to green silicon carbide mineral, D50=5.5 micrometers, available as GC 2500 GREEN SILICON CARBIDE from Fujimi Corp.

"FIL" refers to fumed silica, commercially available under the trade designation OX-50 from The Cary Company of Addison, Ill.;

"DSP1" refers to an anionic polyester dispersant, obtained under the trade designation SOLPLUS D520 from Lubrizol Advanced Materials of Cleveland, Ohio;

"TP1" refers to an automotive clearcoat test panel available as GEN IV AC from Du Pont Automotive of Troy, Mich.; and "UVI1" refers to acylphosphine oxide available as LUCERIN TPO-L from BASF Corp. of Florham Park, N.J.

Cut-Life Test

The cut-life test was performed as follows:

A disc having a diameter of 1.25 inches (3.18 cm) of the indicated abrasive article was adhered to a 5-inch (12.7 cm) by 1.25 inches (3.18 cm) thick vinyl faced foam back up pad available as 3M FINESSE-IT STIKIT BACKUP PAD from 3M Company. The back up pad was mounted on a fine finishing orbital sander available as DYNABRADE MODEL 59025 from Dynabrade, Inc. of Clarence, N.Y.

For Example 6 and Comparative Examples L-M, a hooked attachment member available as the adhesive backed hooked portion of a 3M SCOTCHMATE HOOK AND LOOP RECLOSABLE FASTENER from 3M Company, cut down to a 1.25 inch (3.2 cm) diameter disc, was attached to a back up pad available as 3M STIKIT ROLOC DISC PAD 02727, 1¼ inch (3.2 cm)×5/16 inch (0.8 cm) from 3M Company using the adhesive layer on the adhesive backed hooked portion, and used as a backup pad instead of the 3M FINESSE-IT STIKIT BACKUP PAD.

The abrasive layer of the disc was then misted with water in an amount sufficient to cover the entire surface of the abrasive layer using 1 or 2 squirts of liquid from a 24-ounce (0.71-liter) spray bottle. The abrasive layer was manually brought into contact with a clearcoated surface of workpiece TP1, which was then abraded for 3 to 5 seconds at 7,500 revolutions per minute (rpm) at 90 psi (621 kilopascals) and an angle of zero degrees (i.e., manually held flat to the surface of the workpiece). The misting and abrading steps were repeated on adjacent areas of the test panel until the abrasive disc became clogged with debris, as visually indicated by incomplete clearcoat removal. The number of times the abrasive disc could be used without clogging (i.e., number of cycles) was reported as the cut-life of the abrasive disc.

Examples 1-5 and Comparative Examples A-B

Abrasive slurries ABR3-ABR7 were prepared as follows: 15.8 parts of ACR1, 15.8 parts of ACR2, 0.71 part of DSP1, 1.94 parts of CPA1, 1.1 parts of UVI1, 1.64 parts of FIL, AD1 surfactant in amounts as indicated in Table 1, and 60 parts of MIN1 were homogeneously dispersed for one hour using a mechanical mixer at a temperature not exceeding 30° C.

Each slurry was applied via knife coating to a 12 inch (30.5 cm) wide microreplicated polypropylene tooling having uniformly distributed, close packed, alternating 34 degree helical cut, pyramidal arrays having 11 by 11 rows of base width 3.3 mils by 3.3 mils (83.8 by 83.8 micrometers) by 2.5 mils (63.5 micrometers) depth, separated by 3 by 3 rows of the same pyramidal array truncated to a depth of 0.83 mil (21 micrometers), as shown in FIG. 2 of U.S. Pat. No. 7,410,413 (Woo et al.). The tool was prepared from a corresponding master roll generally according to the procedure of U.S. Pat. No. 5,975,987 (Hoopman et al.). The slurry filled polypropylene tooling was then laid on a 12-inch (30.5-cm) wide web of ethylene acrylic acid primed polyester film, 3.71 mil (94.2 micrometers) thick, obtained as MA370M from 3M Company, passed through a nip roll (nip pressure of 90 pounds per square inch (psi) (620.5 kilopascals (kPa)) for a 10 inch (25.4 cm) wide web), and irradiated with an ultraviolet (UV) lamp, type "D" bulb, from Fusion Systems Inc., Gaithersburg, Md., at 600 Watts/inch (236 Watts/cm) while moving the web at 30 feet/minute (fpm) (9.14 meters/minute). The polypropylene tooling was separated from the ethylene acrylic acid primed polyester film, resulting in a fully cured precisely-shaped abrasive layer adhered to ethylene acrylic acid primed polyester film. Pressure-sensitive adhesive was laminated to the backside (opposite that abrasive layer) of the backing. Discs (1.25-inch (3.18-cm) in diameter) were then die cut from the structured abrasive article.

Structured abrasive articles were prepared as reported in Table 1. Cut-Life Test results for the corresponding structured abrasive articles are reported in Table 1 (below).

TABLE 1

| EXAMPLE | STRUCTURED ABRASIVE ARTICLE | SURFACTANT | CONCENTRATION OF SURFACTANT, percent by weight | CUT-LIFE TEST, cycles, after at least one day of aging (three trials) | CUT-LIFE TEST, cycles (average) |
|---|---|---|---|---|---|
| Comparative Example A | ABR1 | none | 0 | 4, 4, 3 | 3.6 |
| Comparative Example B | ABR2 | none | 0 | 5, 4, 5 | 4 |
| Example 1 | ABR3 | AD1 | 2.0 | 6, 7, 6 | 6.3 |
| Example 2 | ABR4 | AD1 | 2.5 | 8, 10, 12 | 10 |
| Example 3 | ABR5 | AD1 | 2.93 | 10, 12, 12, 12 | 12 |
| Example 4 | ABR6 | AD1 | 3.0 | 11, 12, 11 | 11.3 |
| Example 5 | ABR7 | AD1 | 3.5 | 7, 8, 7 | 7.6 |

Example 6 and Comparative Examples C-D

Abrasive slurries ABR8-ABR10 were prepared as follows: 1.08 parts UVI1, 3.08 parts DSP1, 1.92 parts CPA1, 19.48 parts ACR2, 12.94 ACR1, AD1 surfactant in amounts as indicated in Table 2, and 68.5 parts of MIN2 were homogenously dispersed for approximately 60 minutes using a laboratory mixer with a Cowles blade. This slurry was applied via knife coating to a 12 inch (30.5 cm) wide microreplicated polypropylene tooling having the repeating pattern that is shown in FIGS. 14 and 15 of U.S. Pat. No. 6,923,840 (Schutz et al.). The tool was prepared from a corresponding master roll generally according to the procedure of U.S. Pat. No. 5,975,987 (Hoopman et al.). The slurry filled polypropylene tooling was then contacted in a roll nip by a length of 0.090 inch (2.3 mm) thick R600U foam from Pinta Foamtec, Minneapolis, Minn. The surface of the R600U foam that contacted the slurry had been spray coated with Hycar 2679 from the Lubrizol Corporation of Wickliffe, Ohio at a coating weight of about 8 grams/sq. ft. dry. The opposite side of the foam contained a white cloth backing (HI/Know 94 backing available from 3M Company) and was adhesively laminated to the foam surface.

The construction of polypropylene tooling, slurry and foam was then passed through a nip roll (nip pressure of 60 pounds per square inch (psi) (413 kilopascals (kPa)) for a 8 inch wide web), and irradiated with an ultraviolet (UV) lamp, type "D" bulb, from Fusion Systems, Inc. of Gaithersburg, Md. at 600 Watts/inch (236 Watts/cm) while moving the web at 70 feet/minute (fpm) (21.33 meters/minute). The polypropylene was separated from the foam, resulting in a precisely-shaped abrasive layer adhered to portions of the foam. Discs (1.25-inch (3.18 cm) in diameter were then die cut from the structured abrasive article. The cut life test was performed as described above.

TABLE 2

| EXAMPLE | STRUCTURED ABRASIVE ARTICLE | SURFACTANT | CONCENTRATION OF SURFACTANT, percent by weight | CUT-LIFE TEST performed within 4 hours of structured abrasive manufacture, cycles (two trials) | CUT-LIFE TEST performed one day of structured abrasive manufacture, cycles (two trials) |
|---|---|---|---|---|---|
| Comparative Example C | ABR8 | none | 0 | 10, 12 | 10, 11 |
| Comparative Example D | ABR9 | AD1 | 1.8 | 4, 4 | 18, 19 |
| Example 6 | ABR10 | AD1 | 3.3 | 8, 7 | 16, 15 |

All patents and publications referred to herein are hereby incorporated by reference in their entirety. Various unforeseeable modifications and alterations of the present disclosure may be made by those skilled in the art without departing from the scope and spirit of the present disclosure, and it should be understood that the present disclosure is not to be unduly limited to the illustrative embodiments set forth herein.

What is claimed is:

1. A structured abrasive article comprising:

a backing having first and second opposed major surfaces; and a structured abrasive layer disposed on and secured to the first major surface, the structured abrasive layer comprising shaped abrasive composites, wherein the shaped abrasive composites comprise abrasive particles and nonionic polyether surfactant dispersed in a crosslinked polymeric binder, wherein the abrasive particles have a mean particle size of less than 10 micrometers, wherein the nonionic polyether surfactant is not covalently bound to the crosslinked polymeric binder, and wherein the nonionic polyether surfactant is present in an amount of from 2.5 to 3.5 percent by weight based on a total weight of the shaped abrasive composites.

2. The structured abrasive article of claim 1, wherein the nonionic polyether surfactant is present in an amount of from 2.8 to 3.2 percent by weight based on a total weight of the shaped abrasive composites.

3. The structured abrasive article of claim 1, wherein the shaped abrasive composites are precisely-shaped.

4. The structured abrasive article of claim 1, wherein the crosslinked polymeric binder comprises an acrylic polymer.

5. The structured abrasive article of claim 1, wherein the surfactant comprises a polyethylene oxide segment.

6. The structured abrasive article of claim 1, wherein the surfactant comprises a polypropylene oxide segment.

7. The structured abrasive article of claim 1, wherein the shaped abrasive composites further comprise an anionic phosphate polyether ester, wherein the anionic phosphate polyether ester is present in an amount by weight that is less than that of the nonionic polyether surfactant.

8. The structured abrasive article of claim 1, wherein the backing comprises a polymer film.

9. The structured abrasive article of claim 8, wherein the polymer film comprises and elastomeric polyurethane.

10. The structured abrasive article of claim 1, wherein the backing comprises a polymer foam.

11. The structured abrasive article of claim 1, wherein the structured abrasive article further comprises an attachment interface layer comprising a layer of pressure-sensitive adhesive disposed on the second major surface.

12. The structured abrasive article of claim 1, wherein the structured abrasive article further comprises an attachment layer comprising a looped fabric.

13. A method of abrading a workpiece, the method comprising:

frictionally contacting at least a portion of the structured abrasive layer of the structured abrasive article of claim 1 with a surface of a workpiece while in the presence of an aqueous fluid; and moving at least one of the workpiece or the structured abrasive layer relative to the other to abrade at least a portion of the surface of the workpiece.

14. The method of claim 13, wherein the aqueous fluid consists of municipal tap water or well water.

* * * * *